US006230495B1

(12) United States Patent
Benesch et al.

(10) Patent No.: US 6,230,495 B1
(45) Date of Patent: May 15, 2001

(54) METHOD FOR OPTIMIZING FOSSIL-FUELED POWER STATIONS

(75) Inventors: Wolfgang Benesch, Bochum; Georg Händel, Oer-Erkenschwick; Dietmar Gocht; Matthias Lange, both of Ratingen, all of (DE)

(73) Assignee: STEAG encotec and Ketek Engineering GmbH Engergieund Umwelttechnik (DE)

( * ) Notice: Subject to any disclaimer, the term of this patent is extended or adjusted under 35 U.S.C. 154(b) by 0 days.

(21) Appl. No.: 09/319,107

(22) PCT Filed: Nov. 19, 1997

(86) PCT No.: PCT/EP97/06466

§ 371 Date: Jul. 29, 1999

§ 102(e) Date: Jul. 29, 1999

(87) PCT Pub. No.: WO98/23853

PCT Pub. Date: Jun. 4, 1998

(30) Foreign Application Priority Data

Nov. 27, 1996 (DE) ..... 196 49 184
Oct. 31, 1997 (DE) ..... 197 48 315

(51) Int. Cl.[7] ..... F01K 13/02
(52) U.S. Cl. ..... 60/660; 60/664
(58) Field of Search ..... 60/660, 664

(56) References Cited

U.S. PATENT DOCUMENTS 4,069,675 * 1/1978 Adler et al. ..... 60/667
4,454,840 * 6/1984 Dziubakoski ..... 122/390
4,466,383 * 8/1984 Klatt et al. ..... 122/379
4,996,951 3/1991 Archer et al. .
5,347,466 9/1994 Nichols et al. .

FOREIGN PATENT DOCUMENTS 0 573 140 1/1993 (EP) .

OTHER PUBLICATIONS

Industrial Powerhouse System Coordination; A.C. Sommer et al; 1985; pp. 63–71.

* cited by examiner

*Primary Examiner*—Hoang Nguyen
(74) *Attorney, Agent, or Firm*—Robert W. Becker & Associates

(57) ABSTRACT

In a method for optimizing operation of fossil fuel based power plants, in which the economical effects of the changes of selected operational parameters are determined under consideration of the required economical expenditure, and, based on these additional operational costs, it is determined if, when, and/or what kind of measures should be taken for minimizing the additional operational costs. According to the method, the improvement measures are initiated as a function of the cause of the additional operational costs according to a hierarchal catalog of measures. The measures are: an immediate intervention into the operational course; a later measure implemented during a short shutdown; a later measure implemented during a service shutdown; and/or an operational downtime for a revision.

10 Claims, No Drawings

METHOD FOR OPTIMIZING FOSSIL-FUELED POWER STATIONS

BACKGROUND OF THE INVENTION

The invention concerns a method for optimizing fossil-fueled power plants (stations).

For fossil fuel based power plants, operating procedures and systems are known that monitor the power plants during operation and determine their efficiency. Additionally, methods are known to improve the efficiency of power plants during operation by respective control and adjustment changes.

To increase and/or maintain the efficiency of power plants above a minimum level, it is necessary to carry out improvement and maintenance procedures during which the power plant is shut down. Furthermore, it is customary to carry out service, maintenance, and improvement programs according to a specified, set time schedule during operation, or during shutdown of the plant.

The above described customary practice is comparatively inflexible and does not take into consideration economical aspects.

SUMMARY OF THE INVENTION

The object of the invention is therefore to provide a method for an especially economically optimized operation of power plants. The performance capability of the respective power pant should be used to its full potential by optimizing its operation.

The object of the invention is inventively solved by determining the economical benefits of the measures for improving the efficiency of the power plant and, additionally, the necessary economical expenditures, and by deciding, based on a comparison of the economical expenditures, and by deciding, based on a comparison of the economical benefits and expenditures of the improvement measures, if, when, and/or which improvement measures should be undertaken.

Using the inventive method of comparing the essential economical effects of improvement measures and the expected economical benefits, on the one hand, with the necessary expenditures for performing the measures, on the other hand, it is possible to operate power plants in an economically optimized manner.

According to an especially advantageous embodiment of the inventive method, the improvement measures are modifications to the operating procedure and/or interventions during operation, or service, improvement, and/or modification measures during downtime. During operation without downtime, it is advantageous for optimizing the efficiency of the facility to intervene in the process control, for instance, by blowing soot or correcting excess air etc., whereby, however, the necessary expenditures, for instance, the amount of steam consumption (or the compressed air consumption) of the utilized soot blowers, is taken into consideration in accordance with the inventive method so that an assessment can be made whether the measures to improve efficiency are economically beneficial and, if this is not the case, whether to implement them at a later time or not to implement them at all.

The same holds true for service, improvement, and/or modification measures during downtime. By determining and assessing the expenditures of such measures and/or the economical losses during a shutdown and by comparing the respective results to the economical benefits of the achieved improvement of the plant efficiency, it is possible to decide not only in regard to process control aspects, but also in regard to the economical aspects, whether improvement measures should be implemented, and, if so, what kind of measures, and, in particular, when such measures should be implemented, for instance, during an already necessary operation shutdown.

According to the inventive method, the current status of the plant, based on measured data, for instance, provided by a process control system, as well as calculations based on plant models, is compared to the optimized status that can be achieved with operational parameters. According to another embodiment of the invention, to achieve this economically optimized plant status, the improvement measures are evaluated with regard to economical benefits using a catalog of hierarchical measures. Advantageously, this catalog includes an immediate, hierarchical intervention of the operating procedure, for instance, for correcting excess air, but also in regard to blowing soot off selected or all heating surfaces, cleaning the condenser, or adjusting or readjusting injection control circuits. Based on the result of the cost/benefit analysis, it may be advantageous to take immediate action during operation or to take advantage of a short shutdown for improvement measures, for instance, the replacement or attachment of air preheater sealing material, or to use a service shutdown and/or operating interruption, performed for a revision, for the improvement measures or for more extensive modifications, for instance, for blower improvements.

To compare, for example, the benefits of improvement measures with the required expenditure on an economical basis, the cost savings due to the reduction of excess air must be compared to the higher costs resulting from the increase of intermediate superheater injection, and the result must be evaluated. For instance, the cost of steam and compressed air in conjunction with the use of soot blowers must be compared to the cost savings resulting from the accordingly lowered exhaust losses.

BRIEF DESCRIPTION OF PREFERRED EMBODIMENT

An embodiment with the following step sequence is very advantageous:

Determination of efficiency loss of the plant by comparing the actual efficiency with the optimal efficiency possible under the actual operational conditions;

Determination of the costs that will be incurred for improving the plant efficiency by operating process modifications and/or interventions during an operational shutdown;

Determination of the economical losses due to the lower efficiency of the plant;

Comparison of the costs and the economical losses; and

Decision, based on this comparison, if, when, and/or what kind of measures should be taken.

The actual efficiency (boiler and block) is advantageously determined by measured and calculated operational data. Advantageously, the process status data are provided by a process control system. It is especially advantageous in this context when the calculation of the operating data includes plant model calculations. In this context, the plant models are advantageously combustion calculations, combustion chamber models, boiler models, models of the steam circulation, whereby these calculated operational data are advantageously based on measured operating data, for instance, air and/or flue gas data, electrical data.

These calculated and/or measured operating data provide information about, among other things, the degree of contamination of individual heating surfaces inside the boiler, in addition to the determination of characteristic values such as boiler and plant efficiency. Operation optimization systems that operate according to the inventive method, in particular, by utilizing computers and computer software, advantageously operate independently of the process control system. The process control system only provides the measured data necessary for evaluation calculations and processing of operational data.

The determination of the increased operational costs of the actual operation in comparison to an economically optimized plant operation is preferably achieved by iterative optimization calculations.

The inventive method is advantageously suitable to save primary energy by recognizing and utilizing the operating reserves of the specific plant. However, the inventive method may also be used with great advantage for the following applications:

Assessment of known sources of losses in power plant operations and/or certain areas of power plant operations;

Indication of plant components that deviate from optimal operating set points while taking into consideration operating parameters of the actual load operation;

Maximization of the information contents of measured operating data; and/or

Determination of incorrect or implausible measured data.

The specification incorporates by reference the entire disclosure of German priority documents 196 49 184.3 of Nov. 27, 1996, and 197 48 315.1 of Oct. 31, 1997, as well as of International Application PCT/EP97/06466 of Nov. 19, 1997.

The present invention is, of course, in now way restricted to the specific disclosure of the specification and drawings, but also encompasses any modifications within the scope of the appended claims.

What is claimed is:

1. A method for optimizing operation of fossil fuel based power plants, said method comprising the steps of:

a) determining the economical effects of the changes of selected operational parameters under consideration of the required economical expenditure;

b) determining, based on these additional operational costs, if, when, and/or what kind of measures should be taken for minimizing the additional operational costs; and c) initiating the improvement measures as a function of the cause of the additional operational costs according to a hierarchal catalog of measures including:

an immediate intervention into the operational course;

a later measure implemented during a short shutdown;

a later measure implemented during a service shutdown; and/or an operational downtime for a revision.

2. A method according to claim 1, wherein the measures are interventions during operation or during service, improvement, maintenance, and/or modification measures at operational downtime.

3. A method according to claim 1, wherein said step a) comprises the steps of:

a1) determining an efficiency loss of the plant by comparing an actual efficiency value with an optimized efficiency value;

a2) determining the costs resulting from the measures for improving the plant efficiency upon changing the operational course and/or by interventions during the operational downtime;

a3) determining the economical losses resulting from the efficiency losses of the plant;

a4) comparing the costs of the economical losses; and wherein in said step b) the cost comparison of said step a4) is used.

4. A method according to claim 1, wherein in said step a) the actual efficiency is determined based on measured operational date and/or calculated data.

5. A method according to claim 4, comprising the step of providing the measured operational data by a process control system.

6. A method according to claim 1, wherein in said step a) the calculation of a plurality of the data includes plant model calculations.

7. A method according to claim 1, wherein the plant models comprise combustion processes, combustion chamber models, boiler models, models of the steam circulation, and/or thermodynamic balance models.

8. A method according to claim 1, wherein a computer program for determining known loss sources during plant operation and/or in certain areas of the plant operation is provided.

9. A method according to claim 1, wherein a computer program for determining false or implausible measured data is provided.

10. A method according to claim 1, wherein a computer program for designating plant components that, under consideration of the limit parameters present during actual load operation, deviate from optimized operational set point values is provided.

* * * * *